US011542583B2

(12) United States Patent
Prima et al.

(10) Patent No.: US 11,542,583 B2
(45) Date of Patent: Jan. 3, 2023

(54) TERNARY TI—ZR—O ALLOYS, METHODS FOR PRODUCING SAME AND ASSOCIATED UTILIZATIONS THEREOF

(71) Applicants: PARIS SCIENCES ET LETTRES-QUARTIER LATIN, Paris (FR); CENTRE NATIONAL DE LA RECHERCHE SCIENTIFIQUE, Paris (FR); BIOTECH DENTAL, Salon-de-Provence (FR)

(72) Inventors: Frédéric Prima, Rambouillet (FR); Stéphanie Delannoy, Paris (FR)

(73) Assignees: Paris Sciences et Lettres, Paris (FR); Centre National de la Recherche Scientifique (CNRS), Paris (FR); Biotech Dental, Paris (FR)

( * ) Notice: Subject to any disclaimer, the term of this patent is extended or adjusted under 35 U.S.C. 154(b) by 0 days.

(21) Appl. No.: 17/197,633

(22) Filed: Mar. 10, 2021

(65) Prior Publication Data

US 2021/0198779 A1 Jul. 1, 2021

Related U.S. Application Data

(62) Division of application No. 16/765,569, filed as application No. PCT/EP2018/082167 on Nov. 22, 2018, now Pat. No. 10,975,462.

(30) Foreign Application Priority Data

Nov. 22, 2017 (EP) ..... 17202971

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22C 14/00; C22F 1/183
See application file for complete search history.

(56) References Cited

U.S. PATENT DOCUMENTS

| | | | |
|---|---|---|---|
| 5,871,595 | A | 2/1999 | Ahmend et al. |
| 8,168,012 | B2 | 5/2012 | Steinemann |
| 2009/0088845 | A1 | 4/2009 | Abkowitz et al. |

FOREIGN PATENT DOCUMENTS

| | | |
|---|---|---|
| EP | 0988067 | 3/2000 |
| EP | 1225237 | 7/2002 |

(Continued)

OTHER PUBLICATIONS

Medvedev et al., "Microstructure and mechanical properties of Ti—15Zr alloy used as dental implant material," Journal of the Mechanical Behavior of Biomedical Materials, 62: 384-398 (2016).

(Continued)

*Primary Examiner* — Jessee R Roe
(74) *Attorney, Agent, or Firm* — Barnes & Thornburg LLP; G. Peter Nichols

(57) ABSTRACT

The invention relates to the use of a ternary Titanium-Zirconium-Oxygen (Ti—Zr—O) alloy, characterized in that it comprises from 83% to 95.15 mass % of titanium, from 4.5% to 15 mass % of zirconium and from 0.35% to 2 mass % of oxygen, with said alloy being capable of forming a single-phase material consisting of a stable and homogeneous α solid solution of Hexagonal Close Packed (HCP) structure at room temperature in the medical, transport or energy fields.

7 Claims, 4 Drawing Sheets

(56) References Cited

FOREIGN PATENT DOCUMENTS

| | | |
|---|---|---|
| EP | 1375690 | 1/2004 |
| FR | 3037945 | 12/2016 |
| JP | 2001-220631 | 8/2001 |
| WO | WO 2014/073754 | 5/2014 |

OTHER PUBLICATIONS

Search Report issued in Int'l App. No. PCT/EP2018/082167 (dated 2018).

TERNARY TI—ZR—O ALLOYS, METHODS FOR PRODUCING SAME AND ASSOCIATED UTILIZATIONS THEREOF

This application is a divisional application of U.S. application Ser. No. 16/765,569 filed on Nov. 22, 2018, which is a U.S. nationalization under 35 U.S.C. § 371 of International Application No. PCT/EP2018/082167, filed Nov. 22, 2018, which claims priority to European Patent Application No. 172002971.2 filed Nov. 22, 2017 the entire contents of each are incorporated herein by reference.

The invention relates to the field of titanium-based alloys, and more specifically to ternary alloys of this type. Titanium-zirconium-oxygen alloys are concerned by the invention and in particular by the use of them in the medical, transport or energy fields.

BACKGROUND

Titanium and the alloys thereof have been the subject of a special attention for their mechanical and biomechanical properties, specifically because of their high mechanical strength, their resistance to corrosion as well as their biocompatibility.

The article "The effect of the solute on the structure, selected mechanical properties, and biocompatibility of Ti—Zr system alloys for dental applications" published in the magazine 'Materials Science and Engineering C' on Sep. 28, 2013, pages 354 to 359, reveals the influence of the concentration in zirconium on the properties of Ti—Zr alloys and highlights the absence of cytotoxicity noted when using such elements.

Besides, the article "Mechanical properties of the binary titanium-zirconium alloys and their potential for biomedical materials" published in the 'Journal of Biomedical Materials Research' volume 29 pages 943 to 950, in 1995, gives an idea of the state of research on the mechanical properties of titanium-zirconium alloys and their possible utilizations as biomedical material, at that time.

Besides, document FR 3 037 945 is known, which discloses a method for producing a titanium-zirconia composite material, more particularly starting from zirconia powder at a nanometric scale, by additive manufacturing such process enables a correct control of geometry, porosity and interconnectivity; this is the reason why it has been chosen. The product obtained is actually a composite material with a metal matrix and a ceramic reinforcement (particles of oxides). It is preferably used as a dental and/or surgical implant. Such alloy does not, however, fulfil all the requirements of such field of application. As explained in greater details hereinunder, the raw materials used, the method disclosed and the finally obtained material are different from the object of the present invention.

The most often used alloy in dental implantology is TA6V (as a matter of fact Ti-6Al-4V in mass %) the composition of which contains aluminum and vanadium, the long-term toxicity of which is increasingly suspected by scientific bodies and public health inspection services. At the time, such an alloy was chosen because of the interesting combination of its mechanical properties. With the benefit of hindsight and actual experience over time, such alloy raised mistrust in implant producers which now are willing to replace it.

Patent EP 0 988 067 B1 is also known, which protects a titanium-zirconium binary alloy containing both such alloy components as well as up to 0.5% by weight of hafnium, with hafnium being an impurity contained in zirconium.

Such alloy contains approximately 15% by weight of zirconium and an oxygen rate ranging from 0.25% to 0.35 mass %. The implants produced from such alloy have good mechanical properties, without however exceeding those of the TA6V alloy.

Besides, grade 3 or grade 4 commercially pure titanium, enriched with oxygen up to 0.35% is used. Such material is perfectly biocompatible, but its mechanical properties remain insufficient. It can more particularly be noted that the mechanical strength of such type of titanium is lower by at least 300 MPa than that of TA6V. More recently, mechanical resistance of pure titanium has been additionally improved, working on cold-worked material which results in an additional strengthening. The mechanical strength of such type of material is enhanced with respect to commercial annealed titanium. However, this is obtained at the expense of its ductility.

Now it seems important to provide alternative alloys having both an optimized biocompatibility and a combination of mechanical properties greater than those of known materials. Besides, a simple production method is desired.

SUMMARY

The invention aims at remedying the drawbacks of the state of the art, and specifically at providing an alloy combining an excellent biocompatibility and conjugated properties of high mechanical strength and high ductility.

For this purpose, and according to a first aspect of the invention, a ternary Titanium-Zirconium-Oxygen (Ti—Zr—O) alloy is provided, which comprises from 83% to 95.15 mass % of titanium, from 4.5% to 15 mass % of zirconium and from 0.35% to 2 mass % of oxygen, with said alloy being capable of forming a single-phase material consisting of a stable and homogeneous a solid solution with Hexagonal Close Packed (HCP) structure at room temperature.

In other words, the invention relates to a new family of ternary alloys wherein oxygen is considered as a full alloying element, i.e. added in a controlled manner; such titanium-based alloys, of the Ti—Zr—O type, having a high oxygen content (higher than 0.35 mass %), combine an excellent biocompatibility with conjugated properties of high strength and high ductility. Oxygen is here willingly added in a controlled manner, in order to form a ternary Ti—Zr—O alloy forming a stable and homogeneous $\alpha$ solid solution at room temperature. In this alloy, oxygen is a full alloy element in that it is not considered as an impurity, as could be the case in the prior art. According to the invention, oxygen is added through a solid-state process i.e. using powder particles of $TiO_2$ or $ZrO_2$ oxides in controlled quantities, in the course of the method of production by alloy melting.

More specifically, in the case of an alloy with 0.60% of oxygen and 4.5% of zirconium, the alloy according to the invention may have, in a recrystallized condition, a mechanical strength of approximately 900 MPa associated with a ductility over 30%; this is superior to the properties of the known TA6V alloy.

Advantageously, the ternary alloys of the Ti—Zr—O family are single-phase materials whatever the temperature (up to temperatures close to the beta transus temperature). As a consequence, the materials according to the invention are not very sensitive in terms of microstructural gradients. A reduced dispersion is therefore expected, with respect to the properties of the final product; and moreover, it is preferably biocompatible.

The invention further provides a thermomechanical processing route to produce a ternary Ti—Zr—O alloy. The invention proposes a method for producing a ternary Ti—Zr—O alloy wherein the starting product is said alloy in a recrystallized condition, which is then cold-worked at room temperature, during a first step, in order to increase its mechanical strength. A strength increases by approximately 30% is expected, together with a loss in ductility. 'Room temperature' means a temperature of about 25° C.

Preferably, the cold-working consists in cold-rolling.

A reduction rate ranging from 40% to 90% is then preferably used during the step of cold-working (e.g. cold-rolling).

Besides, the method aims at executing a second step, i.e. a heat treatment, which consists in heating the cold-worked alloy at a temperature between 500° C. and 650° C. for a time from 1 minute to 10 minutes, in order to restore the ductility of said alloy while limiting the lowering of its mechanical strength. The aim is to preserve a high level of mechanical strength.

The heat treatment of the second step is also called a flash treatment in this text.

More specifically, alloys according to the invention, after appropriate thermomechanical processing, exhibit a yield strength greater than or equal to 800 MPa.

In addition, alloys according to the invention, after appropriate thermomechanical processing, exhibit an ultimate tensile strength (UTS) close to or higher than 900 MPa.

Alloys according to the invention, after appropriate thermomechanical processing, exhibit a total ductility close to 15% or more.

Besides, the invention relates to the application and the utilization of such an alloy in the medical, transportation, or energy fields. The invention is preferably used for the production of dental implants. Other applications are possible and promising, in the field of orthopedics; maxillofacial surgery, the production of various, different medical devices can take advantage of the invention as well as the industries of transport—more particularly aerospace industry—and energy specifically, but not exclusively, the nuclear field or chemistry, in its broadest sense, find an application for the present invention.

The additive manufacturing of alloys is further aimed at by the invention since the alloys according to the invention are not submitted to the frequently observed gradients of microstructures since they are single-phase and homogeneous in terms of microstructure and chemistry.

BRIEF DESCRIPTION OF THE DRAWINGS

Further characteristics and advantages of the invention will be clear from reading the following description, made in reference to the appended figures, which show.

For greater clarity, identical or similar features are identified by identical reference signs in all the figures.

DETAILED DESCRIPTION

Figure 1:
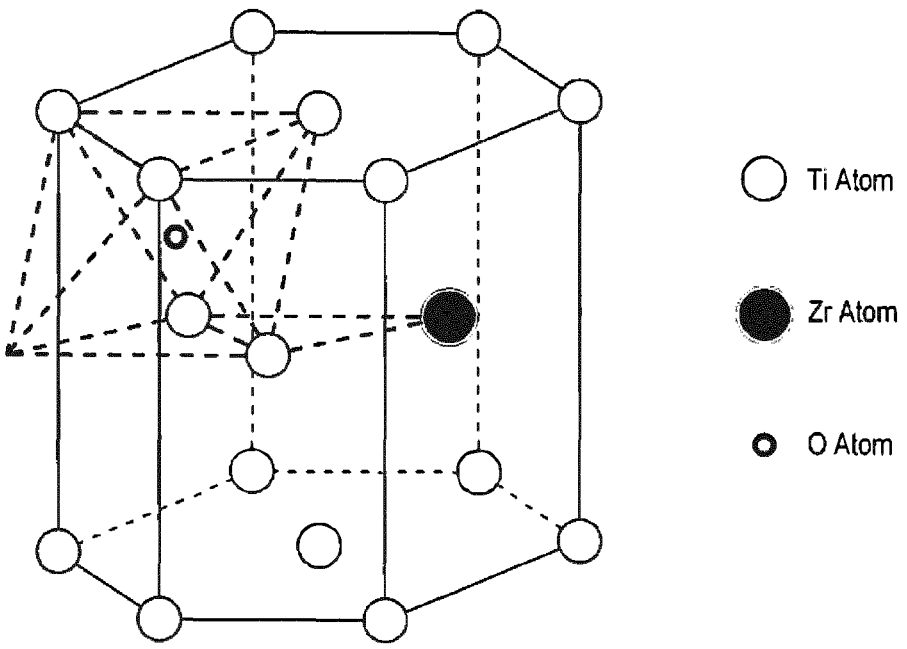
FIG. 1 shows schematically the basic structure of a Ti—Zr—O ternary alloy according to a first embodiment of the invention.

FIG. 1 shows schematically the basic structure of a ternary alloy according to the invention obtained by solid solution hardening. The hardening of the alloy according to the invention, in a recrystallized condition, results from the substitutional (Zr) and interstitial (O) solid solution hardenings. Regarding the occupied sites, it can be seen that, in such a solid solution, zirconium atoms occupy Ti lattice positions (substitutional positions) and the oxygen atoms occupy interstitial positions (between the atoms of the hexagonal lattice). According to this schema, oxygen is a hardening element with an interstitial nature, and zirconium is a hardening element with a substitutional nature.

The invention relies on the desired and exclusive addition of fully biocompatible alloying elements having a high solid solution strengthening capacity. Selecting zirconium results from the capacity thereof to form a homogeneous solid solution with titanium at any temperature. The composition range (from 4.5 mass % to 15 mass % of zirconium) has been chosen in order to keep a titanium-rich alloy with the objective to optimize the cost of alloys. Selecting oxygen as a full alloying element is based on the very high capacity thereof to harden the material. It is usually present in commercial materials in quantities not exceeding 0.35% (mass %) only.

Differently and against a prejudice, in the family of alloys according to the invention, oxygen is added in a high quantity (from 0.35% to 2%) and in a controlled manner, as a solid-state addition of a chosen quantity of $TiO_2$ or of $ZrO_2$, so as to obtain, upon completion of the melting, a homogeneous solid solution as regards its composition, and rich in oxygen. The material obtained is single-phase, with the alpha phase, at any temperature (up to temperatures close to the beta transus temperature).

Figure 2:
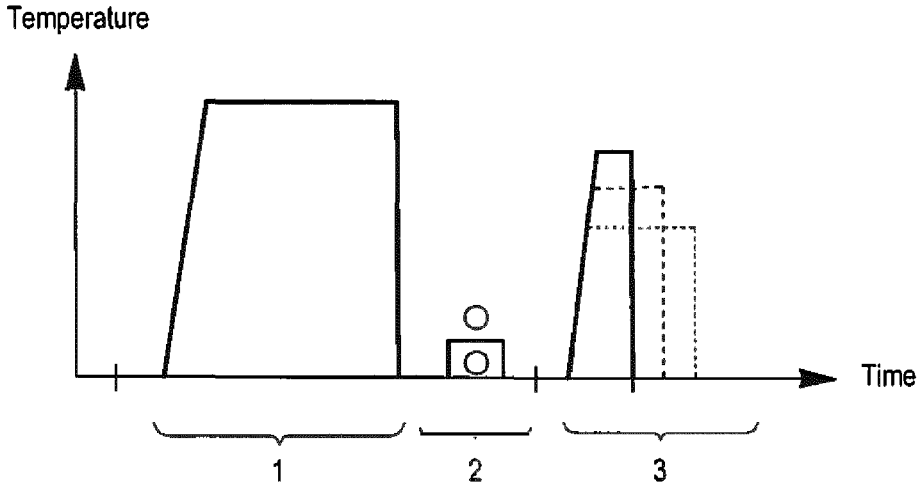
FIG. 2 shows the thermomechanical processing route used to modify the properties of a ternary alloy according to another embodiment of the invention.

Besides, as shown in FIG. 2, a thermomechanical treatment can be used to reach an optimized microstructural condition. An innovative sequence or a succession of thermomechanical treatments of the alloys according to the invention is provided, in order to obtain a more significant strengthening. The method comprises several steps, one of which is a heat treatment which must be short (from 1 min to 10 min) so as to obtain a recovered and not recrystallized condition. According to such treatment, the starting material is in a recrystallized condition (step 1), then a cold-working (e.g. cold-rolling) is carried out, at room temperature (step 2). Reduction rate can range from 40% to 90%, depending on the considered alloy; such step of the method makes it possible to increase the mechanical strength of the material. Then, a short—so called flash—(3) heat treatment is preferably executed, which consists in heating to a temperature ranging from 500° C. to 650° C., for a period ranging from one to ten minutes. The so-called flash heat treatment makes it possible to partially restore ductility while preserving the mechanical strength above that of the starting recrystallized condition. The material thus keeps a high mechanical strength and recovers the ductility lost when the metal has been cold-worked.

The invention thus provides a solution with a ternary alloy exclusively containing a single-phase, with the alpha phase, and completely homogeneous solid solution, i.e. with no precipitates from another additional phase.

Various hardening modes have been considered to reach all such characteristics, by varying the quantities of zirconium and oxygen respectively.

Figure 3:
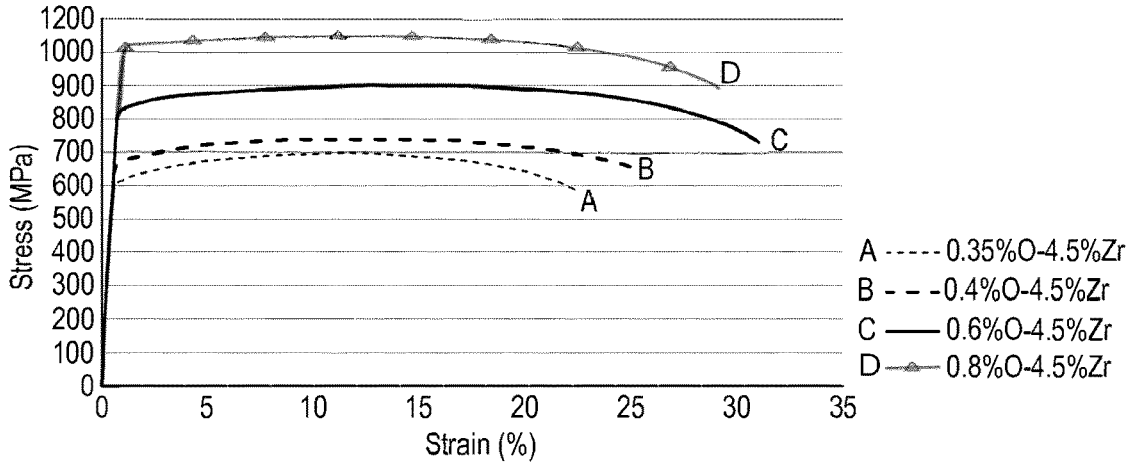
FIG. 3 shows curves illustrating the effect of oxygen on the mechanical properties of recrystallized alloys according to the invention.
Figure 4:
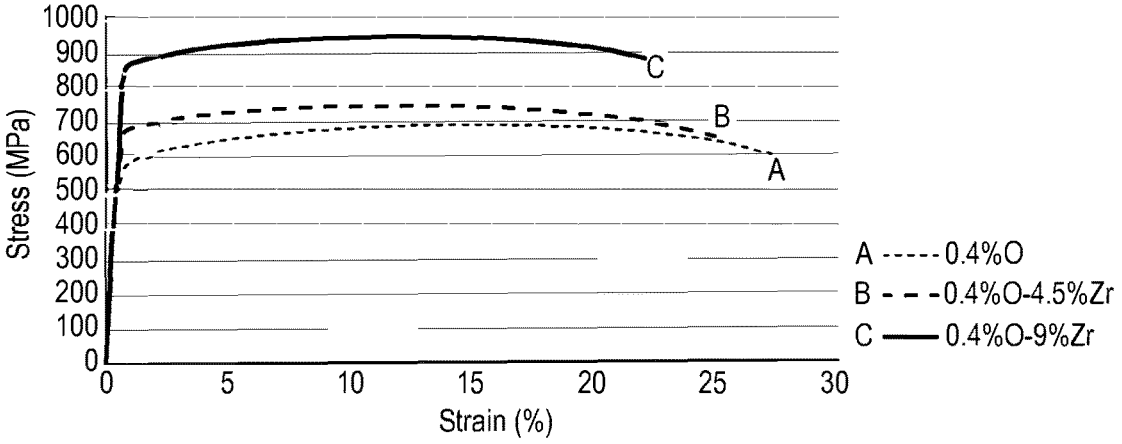
FIG. 4 shows curves illustrating the effect of zirconium on the mechanical properties of recrystallized alloys according to the invention.

As shown in FIGS. 3 and 4 respectively, the effect of solute strengthening, i.e. using a solid solution, could be noted by carrying out mechanical tensile tests on the new alloys, in the recrystallized condition. The increase in the mechanical strength of the alloy can be noted, both after adding oxygen (FIG. 3) and after adding zirconium (FIG. 4).

The four curves of FIG. 3, which show the stress versus the relative elongation (or strain) of the considered alloy, are obtained for alloys with 4.5% of zirconium and for oxygen rates of, respectively 0.35% in curve A, 0.40% in curve B, 0.60% in curve C and 0.80% in curve D.

The three curves of FIG. 4, which show the stress versus the relative elongation (or strain) of the considered alloy, are obtained for alloys with 0.40% of oxygen and for a zirconium content of, respectively 4.5% in curve B and 9% in curve C. The alloy corresponding to curve A contains no zirconium.

Ductility with a recrystallized condition remains very high in the composition range considered, when compared to ductility of commercially pure titanium, for instance (of about 20%).

Figure 5:
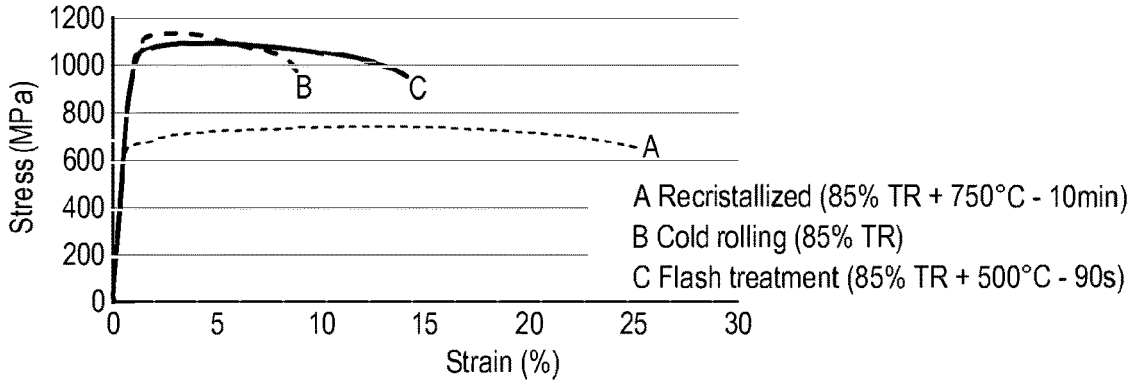
FIG. 5 illustrates the effect of thermomechanical treatments (including a 85% reduction of thickness) on the mechanical properties of an alloy according to the invention.

FIG. 5 shows the additional effect of the various steps in the sequence of thermomechanical treatments on a 0.4% O-4.5% Zr alloy. More precisely, the starting condition is a recrystallized alloy, as shown in curve A. This alloy then has a high ductility, above 25%, but a relatively low mechanical strength of approximately 700 MPa. The execution of cold-working (e.g. cold-rolling), at room temperature, with 85% of reduction in thickness (TR), for instance, makes it possible to significantly increase the mechanical strength, but in return, significantly reduces ductility. Curve B shows such characteristic condition. Curve C shows the condition of the alloy after the subsequent application of a flash heat treatment to such deformed condition. Such heat treatment makes it possible to partially restore ductility while keeping a high mechanical strength. The combined final properties obtained on the 0.4% 0 and 4.5% Zr (mass %) alloy after the cold-rolling and a flash treatment for 1 minute and 30 seconds at 500° C. are higher than those of the known TA6V alloy. As regards the results corresponding to curve C, according to the invention a mechanical strength of approximately 1,100 MPa and ductility of the order of 15% can be noted. As previously known, the mechanical strength of TA6V alloy amounts to about 900 MPa and the associated ductility is about 10%.

Figure 6:
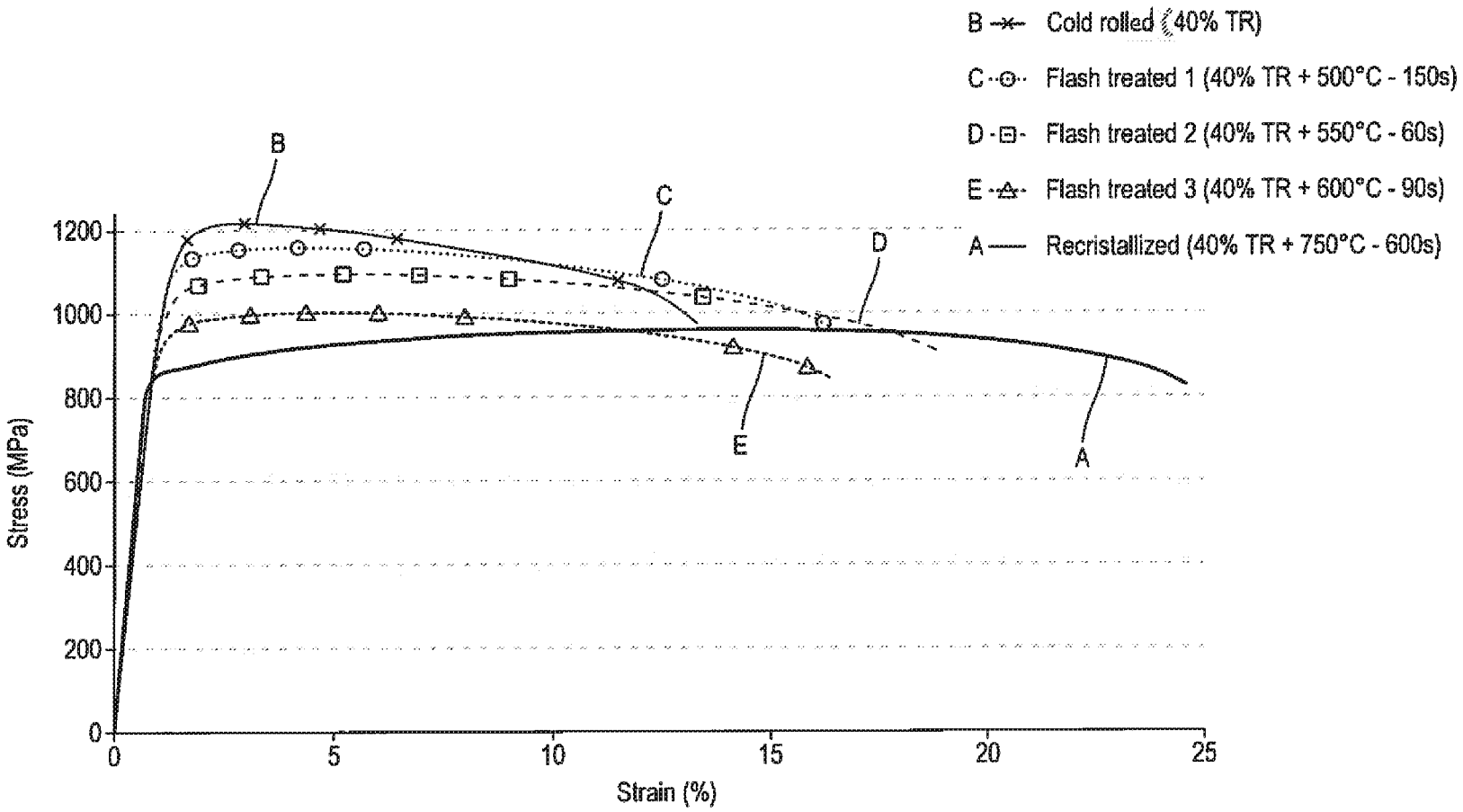
FIG. 6 illustrates the effect of thermomechanical treatments (including a 40% reduction of thickness) on the mechanical properties of an alloy according to the invention.

FIG. 6 illustrates the effects of several thermomechanical treatments on a 0.4% O-9% Zr alloy. Curve A shows the mechanical properties of the recrystallized alloy obtained after a heat treatment operated at 750° C. during 10 minutes. A reduction of thickness (TR) of 40% is then carried out, on said alloy. Curve B relates to the cold-rolled state. "Flash" heat treatments are applied to this cold-worked state. Curve C deals with the material heat-treated at 500° C. during 150 seconds; curve D shows the material heat-treated at 550° C. during 60 seconds; and curve E concerns the material heat-treated at 600° C. lasting 90 seconds. Both recrystallized and heat-treated alloys show interesting mechanical properties, comparable to or higher than the properties of the known TA6V alloy.

Figure 7:
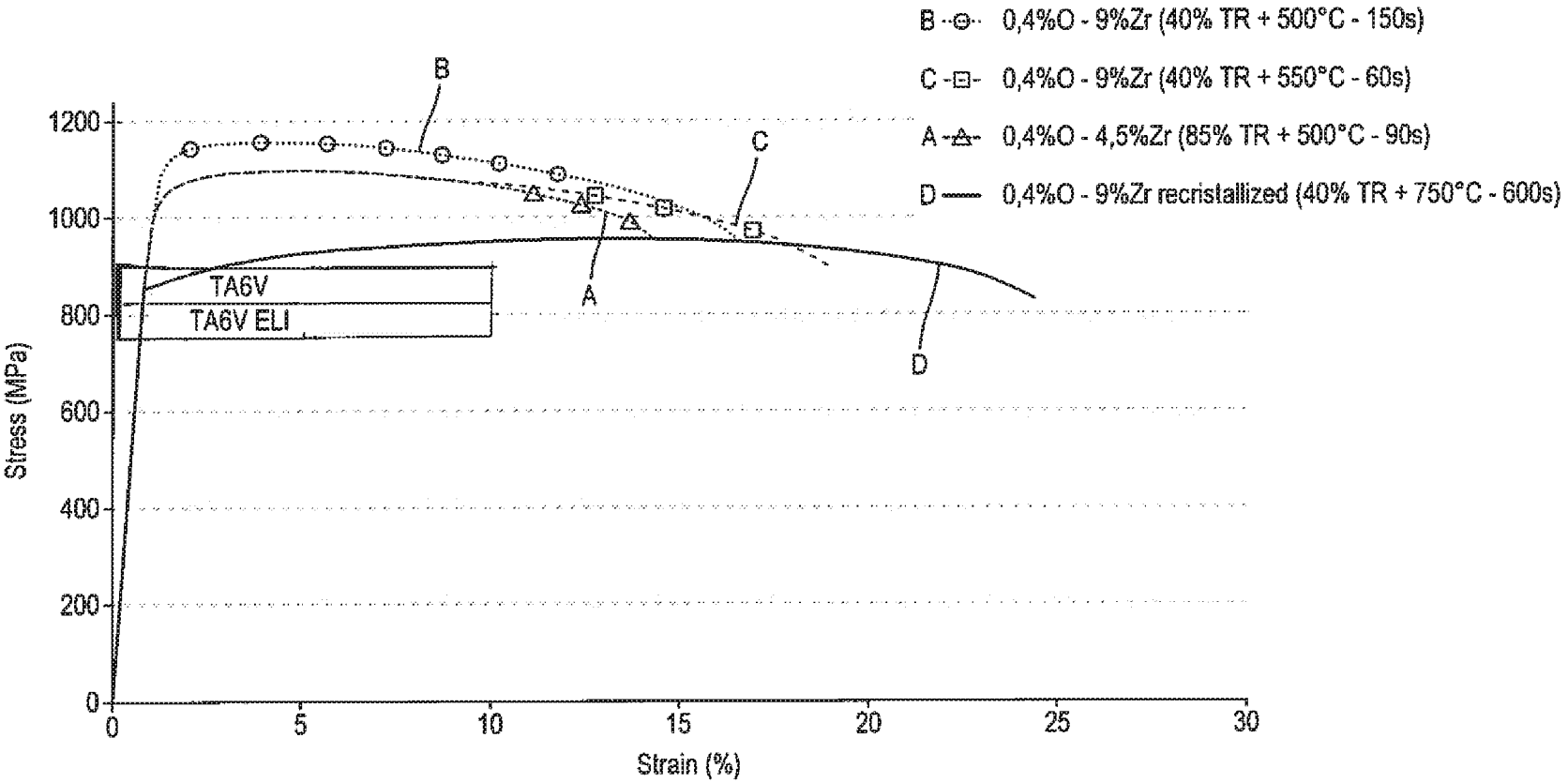
FIG. 7 compares the mechanical properties of Ti—Zr—O ternary alloys obtained according to the invention with the properties of reference alloys.

FIG. 7 shows the superiority of several alloys according to the invention with respect to two known alloys: TA6V and TA6V ELI. TA6V ELI is currently used in medical field. ELI means Extra Low Interstitial. Characteristics of TA6V are illustrated through the upper rectangle whereas characteristics of TA6V ELI correspond to the lower rectangle. For each rectangle, the high level is the typical mechanical strength and the low level is the typical yield strength. The wide of each rectangle, equal to about 10%, corresponds to the ductility of the associated alloy. The four curves of FIG. 7 correspond to alloys according to the invention. They show higher properties than both TA6V-Ti grade 5- and TA6V ELI-Ti grade 23. To confirm the caption of the FIG. 7, curve A corresponds to a ternary alloy with 4.5% of zirconium and 0.4% oxygen to which a heat treatment at 500° C. for 90 seconds is applied after a reduction of thickness (TR) of 85%. Curve B deals with the properties of an alloy comprising 0.4% Oxygen and 9% of zirconium and heat-treated at 500° C. during 150 seconds after a reduction of thickness of 40%; curve C shows the properties of an alloy comprising 0.4% Oxygen and 9% of zirconium and heat-treated at 550° C. during 60 seconds after a reduction of thickness of 40%. Curve D is obtained with a recrystallized alloy comprising 0.4% oxygen and 9% zirconium, this recrystallized state is obtained with a heat treatment at 750° C. for 10 minutes after a 40% reduction of thickness (TR). Curve A of the FIG. 7 is thus the one referenced C on FIG. 5. Curves B, C and D of the FIG. 7 are thus respectively the ones referenced C, D and A on FIG. 6.

As regards preferred method of the invention, a step of cold-working with a reduction rate (or reduction of thickness TR) of 40% or more, is executed on a ternary alloy as described above, and is followed by a step of heat treatment at a temperature ranging from 500° C. to 650° C. for a period ranging from one minute to ten minutes.

The desired and voluntary presence of a controlled, and high, quantity of oxygen in such ternary alloy makes such alloy new. Besides, this goes against a prejudice since, so far, the presence of oxygen was limited or not controlled, mainly because of the impurities existing in the raw materials. In other words, the quantity of oxygen present in the known titanium alloys is generally limited to contents of less than 0.35 mass %, and generally results from the relative impurity of the raw materials used.

Besides, the alloys according to the invention can be in massive or powder forms. Under massive form, the alloys according to the invention can be in a wide range of products such as ingots, bars, wires, tubes, sheets and plates, and so on.

Further, the alloys according to the invention can be easily cold-worked: for example, tubes can easily be formed with such alloys. This results from the ductility level of the alloys according to the invention.

The invention claimed is:

1. A product comprising a ternary Titanium-Zirconium-Oxygen (Ti—Zr—O) alloy comprising from 83% to 95.15 mass % of titanium, from 4.5% to 15 mass % of zirconium and from 0.35% to 2 mass % of oxygen, with the alloy being a single-phase material consisting of a stable and homogeneous $\alpha$ solid solution with a Hexagonal Close Packed (HCP) structure at room temperature.

2. The product according to claim 1 wherein the product is a medical device.

3. The product according to claim 1 wherein the product is a medical device, said medical device being an orthopedic implant.

4. The product according to claim 1 wherein the product is a component for medical applications or dental applications.

5. The product according to claim 1 wherein the product is a component for aerospace applications, nuclear applications, energy applications, chemical processing applications or transportation applications.

6. A ternary Titanium-Zirconium-Oxygen (Ti—Zr—O) alloy comprising from 83% to 95.15 mass % of titanium, from 4.5% to 15 mass % of zirconium and from 0.35% to 2 mass % of oxygen, with the alloy being capable of forming a single-phase material consisting of a stable and homogeneous a solid solution with a Hexagonal Close Packed (HCP) structure at room temperature, said alloy being in the form of a powder.

7. A product comprising a ternary Titanium-Zirconium-Oxygen (Ti—Zr—O) alloy comprising from 83% to 95.15 mass % of titanium, from 4.5% to 15 mass % of zirconium and from 0.35% to 2 mass % of oxygen, with the alloy being capable of forming a single-phase material consisting of a stable and homogeneous $\alpha$ solid solution with a Hexagonal Close Packed (HCP) structure at room temperature, wherein the product is a medical device, the medical device being a dental implant.

* * * * *